US011536116B2

(12) United States Patent
Olson et al.

(10) Patent No.: US 11,536,116 B2
(45) Date of Patent: Dec. 27, 2022

(54) ALTERNATIVE ENERGY BATTERY CHARGING SYSTEMS FOR WELL CONSTRUCTION

(71) Applicant: Cameron International Corporation, Houston, TX (US)

(72) Inventors: Matthew Olson, Cypress, TX (US); Stephen McGuire, Hockley, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/247,606

(22) Filed: Dec. 17, 2020

(65) Prior Publication Data

US 2022/0195848 A1 Jun. 23, 2022

(51) Int. Cl.

| | |
|---|---|
| ***E21B 41/00*** | (2006.01) |
| ***E21B 33/064*** | (2006.01) |
| ***E21B 33/035*** | (2006.01) |
| ***E21B 33/06*** | (2006.01) |

(52) U.S. Cl.

CPC ..... *E21B 41/0085* (2013.01); *E21B 33/0355* (2013.01); *E21B 33/062* (2013.01); *E21B 33/064* (2013.01)

(58) Field of Classification Search

CPC ..... E21B 41/0085; E21B 33/0355; E21B 33/062; E21B 33/064

See application file for complete search history.

(56) References Cited

U.S. PATENT DOCUMENTS 5,166,677 A * 11/1992 Schoenberg ..... E21B 33/0355 166/335
8,686,681 B2 * 4/2014 Stale ..... E21B 41/00 320/101
2011/0308619 A1 12/2011 Martino et al.
2013/0153242 A1 6/2013 Flight et al.
2014/0131049 A1 * 5/2014 Bourgeau ..... E21B 33/063 166/363
2016/0109874 A1 * 4/2016 Holmes ..... E21B 33/0355 700/275
2016/0201423 A1 7/2016 Biester et al.
2018/0073320 A1 * 3/2018 Holmes ..... E21B 33/064
2018/0313192 A1 11/2018 Frosell et al.
2019/0226296 A1 * 7/2019 Rakhunde ..... E21B 34/16
2020/0056630 A1 2/2020 Nault et al.
2020/0157906 A1 5/2020 Bourgeau et al.
2022/0011930 A1 * 1/2022 Arcot ..... E21B 33/064
2022/0056778 A1 2/2022 Olson et al.

FOREIGN PATENT DOCUMENTS

WO WO-2019115584 A1 * 6/2019 ..... F16K 31/043

OTHER PUBLICATIONS

International Search Report and Written Opinion issued in International Patent application PCT/US2021/072952 dated Apr. 13, 2022, 12 pages.

* cited by examiner

*Primary Examiner* — Aaron L Lembo
(74) *Attorney, Agent, or Firm* — Kelly McKinney

(57) ABSTRACT

A drilling rig includes a rig component, an actuator coupled to the rig component, an electric power storage device coupled to the actuator and configured to cause the actuator to actuate. The actuator, by actuating, may perform a safety function in the rig component. The rig also includes a renewable power generator coupled to the electric power storage device and configured to supply at least some of the electric current to the electric power storage device that is supplied to the actuator.

18 Claims, 5 Drawing Sheets

ALTERNATIVE ENERGY BATTERY CHARGING SYSTEMS FOR WELL CONSTRUCTION

BACKGROUND

Drilling rigs are used to bore into the earth to create a well and then to complete and extract hydrocarbons from the well. Drilling rigs include various mechanical devices to accomplish these functions, such as drawworks, top drives, pumps, etc., which may be powered electrically. The drilling rigs also include electrical components such as control panels, sensors, processors, etc., also powered by electricity. Where available, such electrical power is provided by connection to a power grid. However, land rigs may be positioned in remote locations, where grid access may be unavailable or for other reasons difficult to obtain. Providing power lines running to offshore rigs may likewise not be an option. Accordingly, diesel generators are used in such situations to power the rig.

Safety equipment is also provided on the drilling rigs. Generally, this safety equipment is configured to operate even in the absence of an active source of electrical power, e.g., the connection to the grid is interrupted, the generators go offline, etc. Moreover, the safety equipment may call for power at a greater rate than is practical for the electrical power source to provide on demand. Accordingly, the safety equipment may be powered using stored hydraulic energy. For example, hydraulic accumulators may be provided, and hydraulic fluid may be pumped into the accumulators at high pressure when power is available. In an emergency event, the energy stored in the accumulators may be delivered rapidly to the safety equipment, even if electrical power has been lost.

A blowout preventer (BOP) provides an example of such safety equipment. A BOP may be positioned at the wellhead may have one or more rams that are configured to shear a tubular extending therethrough, thereby preventing fluid from escaping from the well into the ambient environment in an emergency situation. In the event of a power loss, valves are operated to direct stored hydraulic fluid from the accumulators to the shear rams, which in turn actuate and seal the BOP.

However, as wells become more complex and BOP stacks become larger, the size of the accumulators called for to deliver the large amounts of energy used to actuate the shear rams can present a challenge. In offshore contexts, rig space is at a high premium, and thus it may be desirable to avoid devoting large portions of the rig to emergency accumulators. In land-based drilling, such large accumulators can present a transportation and space issue as well.

SUMMARY

Embodiments of the disclosure include a drilling rig that includes a rig component, an actuator coupled to the rig component, an electric power storage device coupled to the actuator and configured to cause the actuator to actuate. The actuator, by actuating, may perform a safety function in the rig component. The rig also includes a renewable power generator coupled to the electric power storage device and configured to supply at least some of the electric current to the electric power storage device that is supplied to the actuator.

Embodiments of the disclosure further include a method for powering a rig component. The method includes generating electric current using a renewable power generator of a drilling rig, storing the electric current in an electric power storage device, and actuating an actuator coupled to the rig component by supplying the electric current that was stored from the electric power storage device to the actuator or to an electric-to-hydraulic conversion device that supplies hydraulic power to the actuator.

Embodiments of the disclosure also include a drilling rig including a rig component including a blowout preventer having a ram, an actuator configured to actuate the ram, an electric power storage device coupled to the actuator and configured to supply electric current to the actuator, and a renewable power generator coupled to the electric power storage device and configured to supply at least some of the electric current to the electric power storage device that is supplied to the actuator, the renewable power generator including at least one selected from the group consisting of a solar panel, a wind turbine, a hydroelectric power generator, a geothermal power generator, and a regenerative power generator. The electric power storage device is coupled to a primary power source that provides a first current to the electric power storage device, and the renewable power generator is configured to provide a second current to the electric power storage device, the first current being greater than the second current. The renewable power generator is configured to provide a trickle charge to the electric power storage device, the electric power storage device is configured to discharge over time without actuating the actuator, and the trickle charge is configured to maintain the electric power storage device in a fully charged state.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
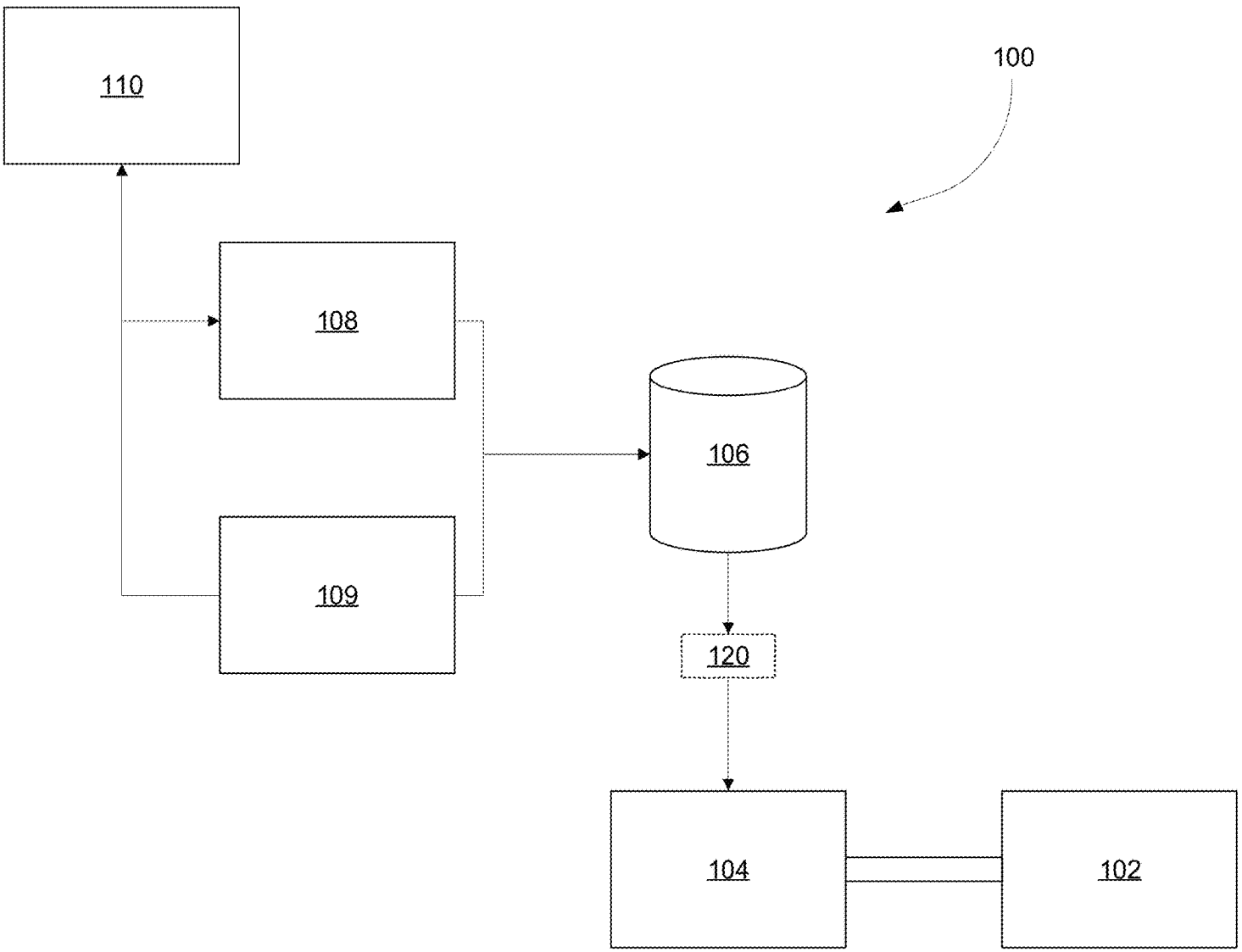
FIG. 1 illustrates a schematic view of a drilling rig, according to an embodiment.

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

In general, embodiments of the present disclosure may avoid or reduce the dependency on hydraulic accumulators in drilling rigs. The present disclosure may provide a rig that includes an electric power storage device, such as battery and/or capacitor arrays. The electric power storage device may be configured to provide near instantaneous power to various rig components that are often provided with power on a similar basis using an accumulator, e.g., in emergency situations or other relatively infrequent occasions. Additionally, the present disclosure may permit harvesting of alternative or "renewable" sources of energy to provide at least a part of this power. Such alternative sources of energy may be insufficient to provide on-demand power at the level used in emergency situations, such as to actuate a ram in a BOP; however, such power may be called for relatively infrequently, while such renewable energy sources may be available almost continuously. Accordingly, the renewable energy sources may be harnessed over time, using the electric power storage device. The stored power may then be released, e.g., rapidly, in order to actuate a rig component, and/or to power various other components of the rig, during a loss of primary power. Various other aspects of the present disclosure will be apparent from the following description of one or more illustrative embodiments, and the foregoing introduction should not be considered exhaustive.

FIG. 1 illustrates a schematic view of a drilling rig 100, according to an embodiment. The drilling rig 100 may be an offshore, surface, or land rig. The drilling rig 100 may include the components and machinery that handle and advance tubulars into a well, withdraw the tubulars from the well, and circulate fluid (e.g., drilling mud) in the well. The drilling rig 100 may also include the rig floor, substructure, and mast, associated structures, seafloor components, and various downhole components, depending on the context in which the drilling rig 100 is employed.

As shown, the drilling rig 100 may generally include a rig component 102. The rig component 102 may be any type of powered component for a drilling rig 100, e.g., drawworks, various motors/drivers to manipulate the position of tubular handling components, rotating components (e.g., top drive), health and safety mechanism, sensors, etc. In a specific embodiment, the rig component 102 may be or include a blowout preventer (BOP). For example, the BOP 102 may include one or more shear rams that may be capable of shearing an oilfield tubular so as to seal the well.

The drilling rig 100 may also include an actuator 104 that is coupled to the rig component 102. The actuator 104 may be mechanically and/or hydraulically coupled to the rig component 102, so as to transmit energy via hydraulic fluid and/or movement of mechanical elements (e.g., shafts, gears, etc.) thereto. For example, the actuator 104 may be an electric motor, a pump, or the like. Continuing with the example of a blowout preventer, the actuator 104 may include a device that causes the shear ram of the BOP 102 to actuate, e.g., a pump or an electric motor. Accordingly, by actuating, the actuator 104 may perform a safety function, e.g., causing the shear ram to seal the BOP.

The drilling rig 100 may include an electric power storage device 106 coupled to the actuator 104 and configured to supply energy (e.g., electric current) to the actuator 104. The electric power storage device 106 may include one or more batteries, one or more capacitors, other electrical devices, or a combination thereof. In some embodiments, the electric power storage device 106 may discharge slowly, over time, even if not used to actuate the actuator 104, as described below.

In some embodiments, the electric power storage device 106 may be or include an uninterruptable power source (UPS), e.g., for the actuator 104. Accordingly, in the event of a loss of rig power (e.g., generator failure, blackout in a power grid, etc.), the electric power storage device 106 may continue to supply power to the actuator 104, at least temporarily. The electric power storage device 106 may thus serve a dual purpose. First, the electric power storage device 106 may accumulate power that is not otherwise being used, so that it is available on an emergency (or other infrequent) basis in a quantity and rate that is greater than what may be generated. Second, the electric power storage device 106 may be capable of maintaining the availability of the safety functionality in the rig component 102 despite the loss of power, e.g., by powering the actuator 104. The electric power storage device 106 may also power other components of the drilling rig 100, either continuously or on an emergency basis, as will be described in greater detail below.

The drilling rig 100 may further include a renewable power generator 108 and a primary power source 109, both of which may be coupled to the electric power storage device 106. The primary power source 109 may be or include a diesel generator, a public power grid, or any other suitable source of electrical power that may be used to power normal rig operations. The primary power source 109 may be capable of supplying sufficient energy to the drilling rig 100 so that its various components are operable continuously. Further, the primary power source 109 may be used to provide at least a partial, initial charge for the electric power storage device 106.

The renewable power generator 108 may also be configured to supply the electric current to the electric power storage device 106. The renewable power generator 108 may provide a "trickle" charge, e.g., a relatively low current (in comparison to that potentially provided by the primary power source 109), to the electric power storage device 106. The electric power storage device 106 may employ this trickle charge to remain full, thereby counteracting natural discharges thereof that occur over time in the power storage components (e.g., battery or capacitors discharging slowly), as mentioned above. In some embodiments, the renewable power generator 108 may be a wind turbine, solar panel, geothermal generator, hydroelectric (e.g., wave or tidal) generator, or a combination of one or more thereof. In another example, the renewable power generator 108 may be configured to harness regenerative energy and store it in the electric power storage device 106. Lowering a mass from the top of a mast toward the rig floor may be an example of such regenerative energy, which may be employed to drive the renewable power generator 108.

The drilling rig 100 may also include a control panel 110. The control panel 110 may be in communication with and configured to control the rig component 102 and/or the actuator 104. The control panel 110 may generally be or include a processor, and thus may be a powered device. The control panel 110 may send signals to the rig component 102 and/or the actuator 104, so as to implement functions, receive sensor readings, and provide information to a user, e.g., via a human-machine interface (e.g., a touch screen). In an embodiment, the electric power storage device 106 may supply power to the control panel 110, such that the control panel 110 may be operable during times when rig power (e.g., from the primary power source 109) is otherwise lost. Further, the control panel 110 may be configured to control the power supplied from the electric power storage device 106 to the actuator 104, so as to control the functioning of the actuator 104.

In at least some embodiments, the actuator 104 or the rig component 102 may be hydraulically operated. Since the electric power storage device 106 stores electric power, and generally not hydraulic power, the rig 100 may include an electric-to-hydraulic conversion device 120. In some embodiments, the actuator 104 may integrate such conversion capabilities, or may be run on electricity, and thus the electric-to-hydraulic conversion device 120 may be omitted. However, in the illustrated embodiment, it is included and serves to convert the electric power provided, e.g., on demand in response to commands from the control panel 110, from the electric power storage device 106 into hydraulic power that drives the actuator 104.

Figure 2:
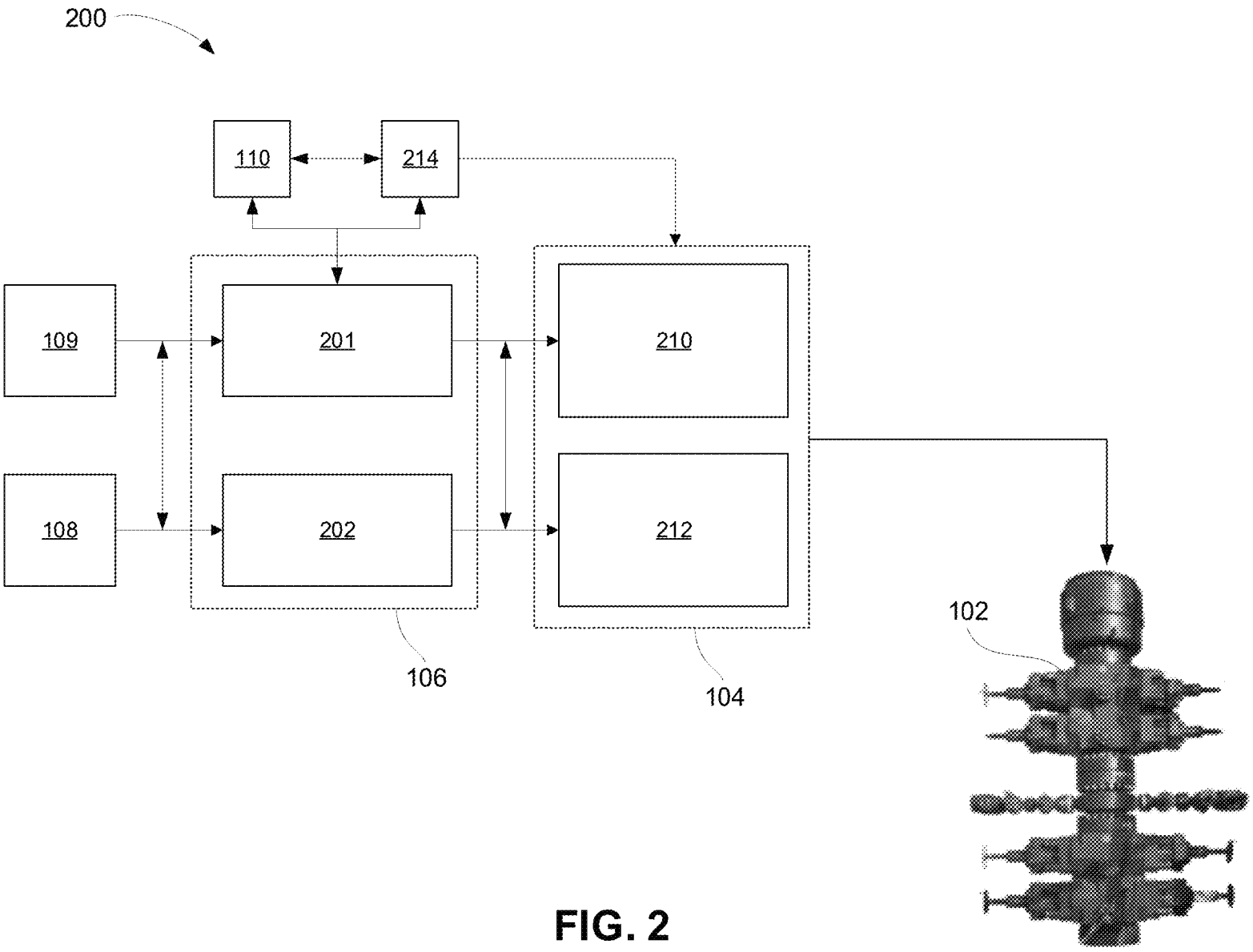
FIG. 2 illustrates a schematic view of another drilling rig, according to an embodiment.

FIG. 2 illustrates a schematic view of a drilling rig 200, according to an embodiment. The drilling rig 200 may be similar to the drilling rig 100, but may, for example, illustrate various aspects in greater detail. The drilling rig 200 may thus include the rig component 102, which may be, as shown, a BOP. The BOP 102 may include various valves, rams, seals, and/or other components that may be actuated via one or more (e.g., hydraulic) actuators. The drilling rig 200 may also include the primary power source 109 (e.g., a diesel generator) and the renewable power generator 108, which may be coupled to the electric power storage device 106. As shown, the primary power source 109 and the renewable power generator 108 may be electrically tied together and operate, in at least some situations, redundantly. Further, at least some of the power may be stored in the electric power storage device 106, while other portions may be used on-demand, e.g., for rig operations.

In other embodiments, power may be employed both on-demand via the electric power storage device 106. For example, the electric power storage device 106 may include a first UPS 201 and a second UPS 202. The first UPS 201 may be coupled directly to the primary power source 109, and the second UPS 202 may be coupled directly to the renewable power generator 108. A cross-over link may be provided, however, which may permit one of the renewable power generator 108 or primary power source 109 to power either/both of the UPSs 201, 202, e.g., when the other of the renewable power generator 108 and the primary power source 109 is offline or otherwise not providing electricity to the rig 200.

The actuator 104 may likewise include two electric actuators 210, 212, one connected directly to each of the UPSs 201, 202, respectively. Further, a cross-over may be provided such that either UPS 201, 202 is capable of providing power to either or both of the electric actuators 210, 212. The electric actuators 210, 212 may each include an electric pump motor assembly, an electric accumulator, or both. The fluid may be pressurized and provided to the rig component 102, e.g., by control from the control panel 110.

The control panel 110 may be coupled to the electric power storage device 106, e.g., to either or both of the UPSs 201, 202. For example, the UPS 201 may be configured to power the panel 110 during normal operation, while the UPS 202 may be configured to power the panel 110 during a rig power loss, e.g., when the primary power source 109 is offline. In another embodiment, the UPS 202 may be configured to power the panel 110 during normal operations, and the UPS 201 may be configured to power the panel 110 during rig power loss (e.g., using power stored on-board). Either or both UPSs 201, 202 may be configured to provide power to the electric actuators 210, 212 so as to power the functionality thereof.

The panel 110 may further include a human-machine interface (HMI) 214. In an embodiment, the HMI 214 may include a touch screen or any other display providing a graphical user interface or another interface for interaction with a human controller, whether at the drilling rig 200 or remotely therefrom.

In some embodiments, the drilling rig 200 may include one or more hydraulic accumulators. The hydraulic accumulators may be coupled to hydraulic pumping units, which may be controlled via the control panel 110. Thus, the hydraulic accumulators may be maintained in a charged state and may be released on demand, e.g., to provide power in addition to the UPSs 201, 202 and the electric actuators 210, 212 to the BOP 102 (e.g., a shear ram thereof).

Figure 3:
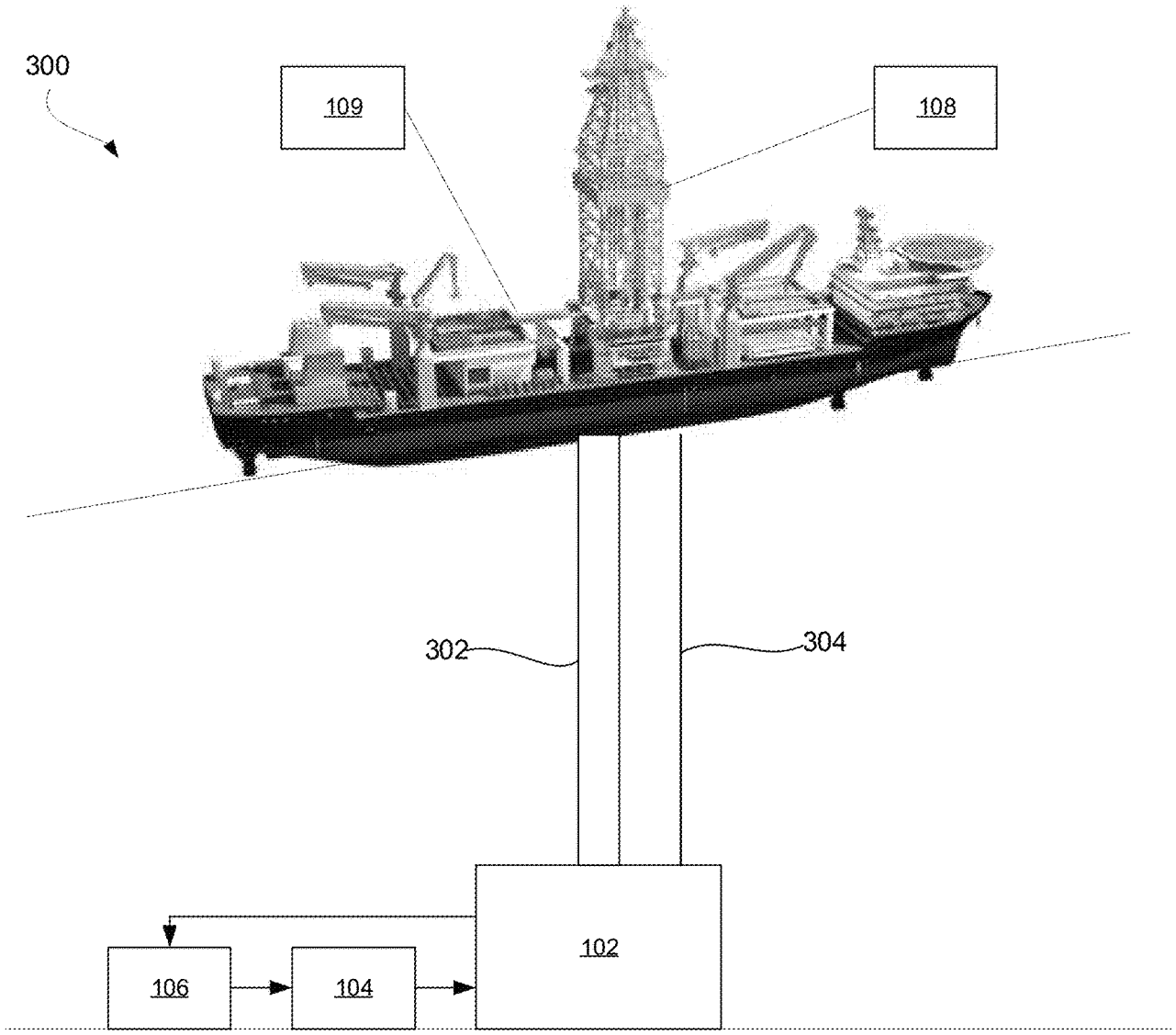
FIG. 3 illustrates a schematic view of yet another drilling rig, according to an embodiment.

FIG. 3 illustrates a schematic view of another drilling rig 300, according to an embodiment. The drilling rig 300 may be a floating offshore rig. The surface components of the drilling rig 300 may thus be connected to the rig component 102 (e.g., BOP) via a riser 302. An electrical ("MUX") cable 304 may electrically connect together the surface components and the rig component 102. The actuator 104 and the electric power storage device 106 (e.g., an electrical accumulator, a saltwater ion charged battery, etc.) may be located at the seafloor, as shown. Accordingly, function read back times (e.g., time between signaling an actuation to occur and receiving a signal representing that the actuation has occurred) may be reduced, since the hydraulic lines are relatively short, as between actuator 104 and the rig component 102, while the electric cable 304 traverses the relatively long distance between the surface and the sea floor, providing near instantaneous power and/or signal transmission therethrough.

In an embodiment, the renewable power generator 108 may be positioned at the surface, as schematically depicted. As such, the renewable power generator 108 may be configured to harness wind, solar, or hydroelectric power. In other embodiments, components of the renewable power generator 108 may instead or additionally be positioned at the sea floor. For example, a turbine may be positioned at the sea floor and configured to harness subsurface water currents, or a geothermal generator may extend into the earth below the seabed. The primary power source 109 may likewise be positioned at the surface.

In the illustrated embodiment, the electric cable 304 brings power from the renewable power generator 108 and/or the primary power source 109, which may be provided to the electric power storage device 106 via the rig component 102. In other embodiments, the power could be supplied directly to the electric power storage device 106, e.g., via a separate cable. In a hybrid electric-hydraulic embodiment, the electric power storage device 106 may supply electric current to an electric-to-hydraulic conversion devices (e.g., the hydraulic conversion device 120 of FIG. 1), which may then supply energy, e.g., mechanical or hydraulic, to the actuator 104 and/or the rig component 102. In an electric actuation embodiment, the electric power storage device 106 may supply electric power directly to the actuator 104.

Figure 4:
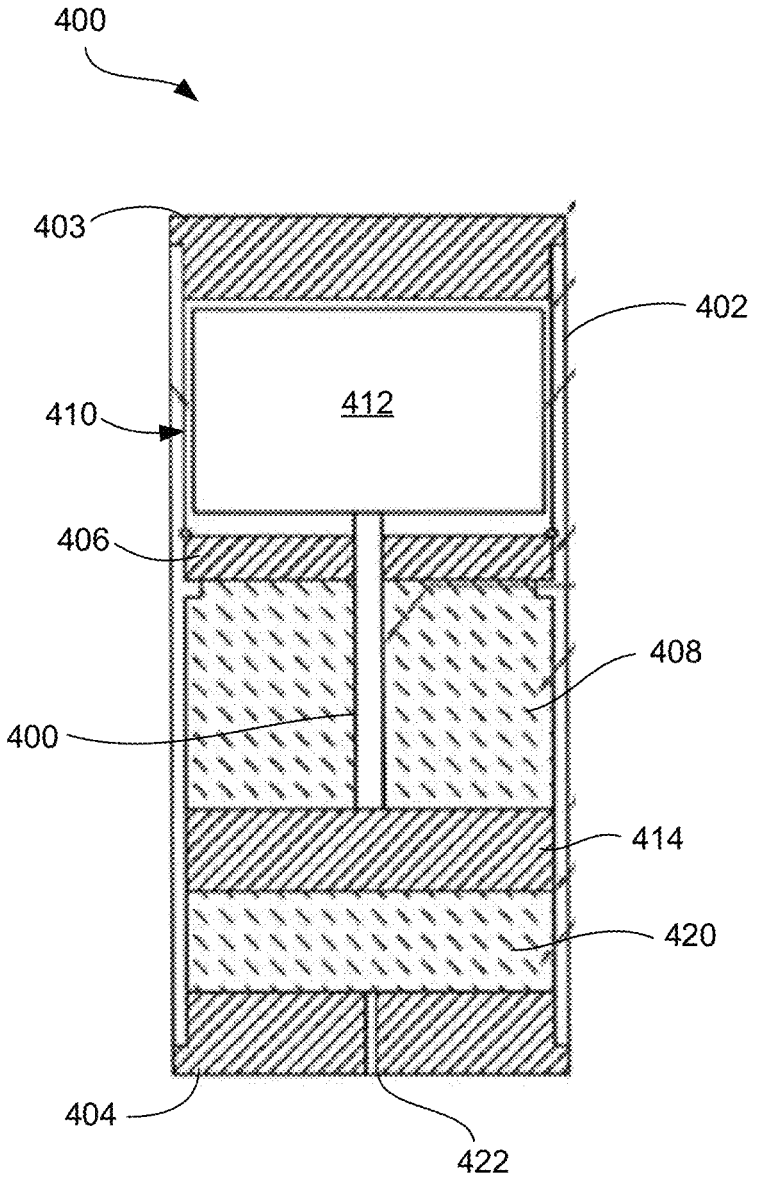
FIG. 4 illustrates a side, schematic view of an electric-to-hydraulic conversion device, according to an embodiment.

FIG. 4 illustrates a side, schematic view of an electric-to-hydraulic conversion device 400, according to an embodiment. The electric-to-hydraulic conversion device 400 may be an example of the hydraulic conversion device 120 of FIG. 1. As shown in FIG. 4, the electric-to-hydraulic conversion device 400 may include a housing 402, with a top cap 403 and a bottom cap 404 on either axial side thereof (e.g., in a cylindrical embodiment of the housing 402).

A partition wall 406 may be positioned in the housing 402, such that a balance chamber 408 and an actuator compartment 410 are defined within the housing 402, on opposite sides of the partition wall 406. An electric actuator 412 may be positioned within the actuator compartment 410. The electric actuator 412 may be a motor, for example. In some embodiments, a battery may also be positioned in the actuator compartment 410. In some embodiments, the battery may be part of the electric power storage device 106 (FIG. 1).

A piston 414 may also be positioned in the housing 402 and may be connected to the electric actuator 412 via a piston rod 416. The piston rod 416 may extend through the balance chamber 408 and through the partition wall 406 to the electric actuator 412. The electric actuator 412 may thus be configured to move the piston 414 axially within the housing 402 via the piston rod 416. Hydraulic fluid may be disposed within the balance chamber 408 between the piston 414 and the partition wall 406.

The housing 402 may also define a function chamber 420 between the bottom cap 204 and the piston 414. Hydraulic fluid may be contained within the function chamber 420 and may be expelled through a port 422 in the bottom cap 404 by movement of the piston 414 toward the bottom cap 404. Thus, energizing the electric actuator 412 may drive the piston 414, and thereby drive the hydraulic fluid from within the housing 402 to an external device (e.g., the actuator 104 and/or the rig component 102), so as to convert electrical energy to potentially high-pressure hydraulic fluid.

Figure 5:
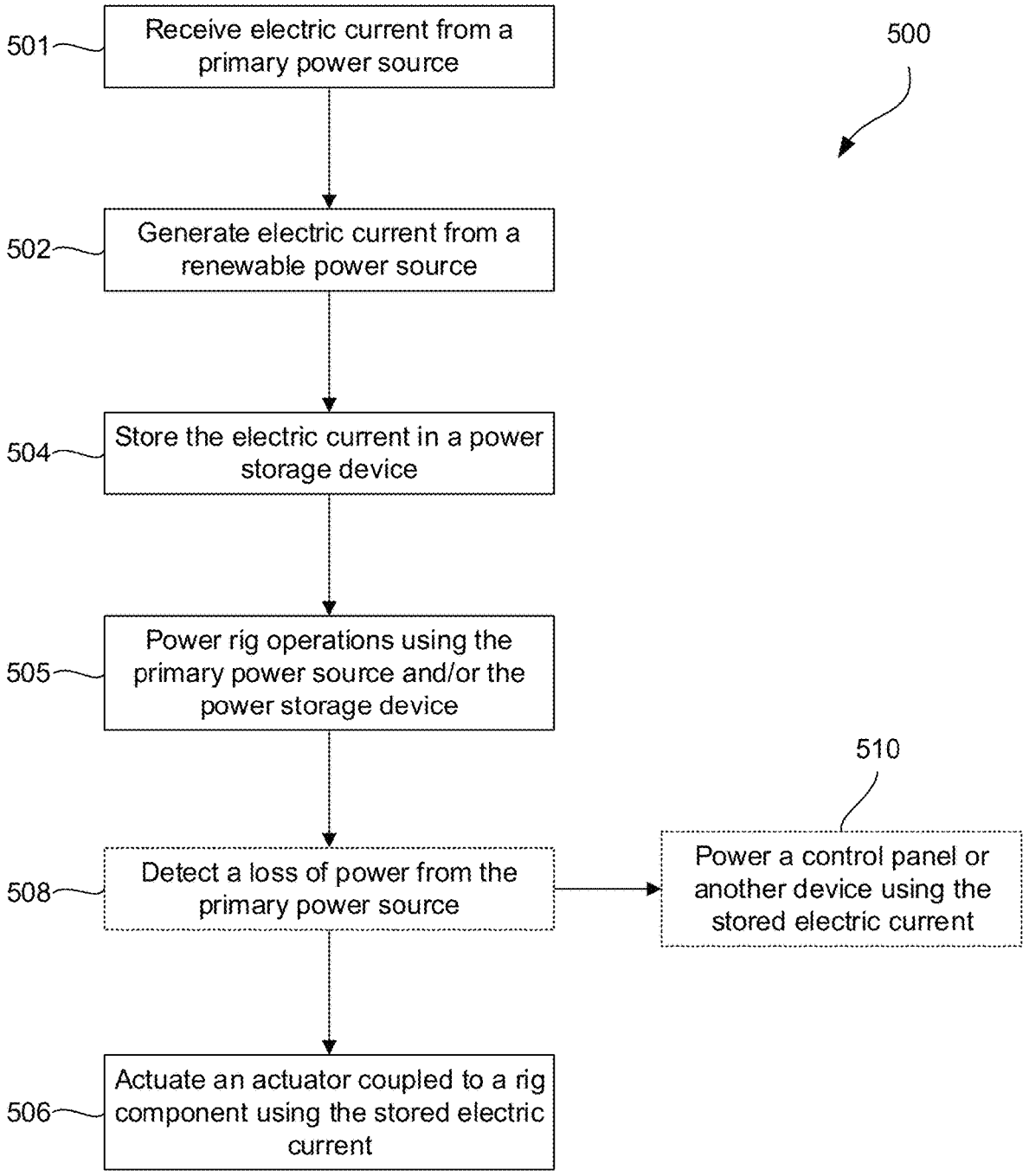
FIG. 5 illustrates a flowchart of a method for powering a rig component, according to an embodiment.

FIG. 5 illustrates a flowchart of a method 500 for powering a rig component 102, according to an embodiment. The method 500 may be executed, for example, by operation of one or more embodiments of the drilling rig 100, 200, 300 discussed above, or others.

The method 500 may include receiving electric current from a primary power source, as at 501. As noted above, the primary power source may be a public power grid, a diesel generator, or any other power source that is configured to supply normal operating power to the rig. The method 500 may also include generating electric current from a renewable power source on a drilling rig, as at 502. The electric current, both received at 501 and generated at 502, may be stored in an electric power storage device on the drilling rig, as at 504. For example, the electric current received at 501 may provide an initial charge of the electric power storage device 106. An initial charge may be provided when the electric power storage device is drained, e.g., prior to a first actuation of an actuator 104 (e.g., at rig up or when the electric power storage device 106 is installed or otherwise initiated) or after a given actuation, to replace the power discharged to actuate the actuator 104.

The electric current generated at 502 may be received on an on-going or intermittent basis as a "trickle" charge that continuously floats or "tops-off" the batteries, capacitors, etc., of the electric power storage device 106. This may maintain the electric power storage device 106 in a fully-charged state (e.g., when a small amount of power discharges, the small amount is replenished via the trickle charge either intermittently or continuously). For example, primary power source 109 may be configured to provide a first amount of power, and the renewable power generator 108 may be configured to provide a second amount of power, which may be less than the first amount of power.

In some embodiments, the method 500 may include powering rig operations directly, using the primary power source 109, and/or using power stored in the electric power storage device 106 (e.g., as a UPS), as at 505.

The method 500 may further include actuating the actuator 104 coupled to the rig component 102 by supplying the electric current that was stored from the electric power storage device 106 to the actuator 104 (or to an electric-to-hydraulic conversion device 120, which then supplies energy to the actuator 104), as at 506. In some embodiments, actuating the actuator 104 includes causing a shear ram (actuator 104) to seal a BOP (rig component 102). Further, the actuator 104 may call for more power to actuate over a short period of time than is available on a continuous basis from the primary power source 109 and/or the renewable power generator 108. For example, a third level of power may be called for to actuator the actuator 104, which may be greater than the first level of power and the second level of power, and, in some cases, may be greater than the sum of the first and second levels of power. Thus, the method 500 may leverage the stored power in the electric power storage device 106, which may provide the third level of power that is sufficient to actuate the actuator 104.

In an embodiment, at 508, the method 500 may also include detecting a loss of power in the primary power source 109, e.g., prior to actuating the actuator 104 at 506. In response, the method 500 may include powering a control panel (and/or event logger, communications panel, etc.) that is connected to the actuator 104 using electric current from the renewable power generator 108 while the primary power source 109 (e.g., generator) is not operating, as at 510. In some embodiments, the control panel 110 may be continuously powered by the electric power storage device 106, e.g., even when the primary power source 109 is operating, and thus the electric power storage device 106 may operate as a UPS for the control panel 110. This may preserve uninterrupted control capabilities via the control panel 110 even in the event of a loss of power in the primary power source 109. Further, in some embodiments, actuating at 506 may include actuating the actuator 104 during the loss of power from the primary power source 109.

In some embodiments, the drilling rig may be an offshore, e.g., floating rig. In such an embodiment, the electric power storage device 106 and the actuator 104 may be located at a seafloor. The renewable power generator 108 may be located at a surface of the ocean. Accordingly, storing the electric current at 504 may include transmitting electric current through an electric cable 304 extending from the surface to the seafloor to the electric power storage device 106.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

As used herein, the terms "inner" and "outer"; "up" and "down"; "upper" and "lower"; "upward" and "downward"; "upstream" and "downstream"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A drilling rig, comprising:

a rig component;

an actuator coupled to the rig component;

an electric power storage device coupled to the actuator and configured to cause the actuator to actuate, whereby the actuator, by actuating, performs a safety function in the rig component; and a renewable power generator coupled to the electric power storage device and configured to supply at least some of the electric current to the electric power storage device that is supplied to the actuator, wherein the renewable power generator is configured to provide a trickle charge to the electric power storage device, wherein the electric power storage device is configured to discharge over time without actuating the actuator, and wherein the trickle charge is configured to maintain the electric power storage device in a fully charged state, wherein the electric power storage device is coupled to a primary power source that provides a first current to the electric power storage device, and wherein the renewable power generator is configured to provide a second current to the electric power storage device, the first current being greater than the second current, wherein the second current is the trickle charge, and wherein the primary power source and the renewable power generator are electrically tied together.

2. The drilling rig of claim 1, wherein the rig component comprises a blowout preventer having one or more rams, and wherein the actuator comprises one or more electric actuators that actuate the one or more rams in response to an electric current supplied from the electric power storage device.

3. The drilling rig of claim 1, wherein the renewable power generator comprises at least one selected from the group consisting of a solar panel, a wind turbine, a hydroelectric power generator, and a geothermal power generator.

4. The drilling rig of claim 1, wherein the renewable power generator comprises a regenerative power generator coupled to one or more other rig components and configured to generate power from operation of the one or more other rig components.

5. The drilling rig of claim 1, wherein the electric power storage device comprises an uninterruptable power source configured to supply power to the actuator.

6. The drilling rig of claim 5, further comprising a control panel in communication with the rig component and configured to control the rig component, wherein the electric power storage device is configured to supply power to the control panel.

7. The drilling rig of claim 6, wherein the control panel comprises a human-machine interface, an event logger that stores a record of rig power loss events, a communications panel for communicating with one or more remote devices, or a combination thereof.

8. The drilling rig of claim 6, wherein the uninterruptable power source is configured to supply power to the actuator during a rig power loss event, and wherein the power supplied during the rig power loss event is supplied at a rate that is greater than the renewable power generator, the primary power source, or both are configured to provide.

9. The drilling rig of claim 1, further comprising an electric-to-hydraulic power conversion device configured to pump hydraulic fluid to the actuator in response to receiving electric current from the electric power storage device.

10. The drilling rig of claim 1, wherein the rig component is located subsea, the electric power storage device is located subsea, and the renewable power generator is located at a surface of the ocean, the drilling rig further comprising a riser and an electrical cable both extending from the surface to the rig component.

11. The drilling rig of claim 1, further comprising:

a control panel coupled to the actuator and configured to control actuation thereof, wherein:

the electric power storage device comprises a first uninterruptable power source (UPS) coupled to a control panel, and a second UPS;

the actuator comprises a first actuator coupled to the first UPS and a second actuator coupled to the second UPS;

the renewable power generator is coupled to the first UPS; and the primary power source is coupled to the second UPS and configured to provide electrical power thereto.

12. A method for powering a rig component, comprising:

receiving a first electric current from a primary power source; and initially charging an electric power storage device using the first electric current from the primary power source, generating a second electric current using a renewable power generator of a drilling rig;

storing the second electric current in the electric power storage device, wherein the primary power source and the renewable power generator are electrically tied together;

actuating an actuator coupled to the rig component by supplying at least the second electric current that was stored from the electric power storage device to the actuator or to an electric-to-hydraulic conversion device that supplies hydraulic power to the actuator, wherein generating the second electric current comprises using the renewable power generator to provide a trickle charge to the electric power storage device, thereby maintaining the electric power storage device in a fully-charged state.

13. The method of claim 12, wherein storing the second electric current generated by the renewable power generator comprises maintaining the primary power source in a charged state while the electric power storage device discharges, and is replenished via the trickle charge, over time prior to actuating the actuator.

14. The method of claim 13, wherein initially charging comprises charging the electric power storage device after actuating the actuator, prior to a first actuation of the actuator, or both.

15. The method of claim 12, further comprising:

detecting a loss of power from the primary power source; and powering a control panel that is connected to the actuator using the second electric current from the renewable power generator while the primary generator is not operating.

16. The method of claim 12, further comprising detecting a loss of power in the primary power source generator, wherein actuating comprises actuating the actuator during the loss of power.

17. The method of claim 12, further comprising powering rig operations using the primary power source configured to provide a first amount of power, wherein the renewable power generator is configured to provide a second amount of power, and wherein actuating the actuator comprises using a third amount of power that is greater than the first amount of power and the second amount of power.

18. A drilling rig, comprising:

a rig component comprising a blowout preventer having a ram;

an actuator configured to actuate the ram;

an electric power storage device coupled to the actuator and configured to supply electric current to the actuator; and a renewable power generator coupled to the electric power storage device and configured to supply at least some of the electric current to the electric power storage device that is supplied to the actuator, the renewable power generator comprising at least one selected from the group consisting of a solar panel, a wind turbine, a hydroelectric power generator, a geothermal power generator, and a regenerative power generator, wherein the electric power storage device is coupled to a primary power source that provides a first current to the electric power storage device, wherein the renewable power generator is configured to provide a second current to the electric power storage device, the first current being greater than the second current, wherein the primary power source and the renewable power generator are electrically tied together, and wherein the renewable power generator is configured to provide a trickle charge to the electric power storage device, wherein the electric power storage device is configured to discharge over time without actuating the actuator, and wherein the trickle charge is configured to maintain the electric power storage device in a fully charged state.

* * * * *